US009144700B2

(12) United States Patent
Burkhart et al.

(10) Patent No.: US 9,144,700 B2
(45) Date of Patent: Sep. 29, 2015

(54) FIRE PROTECTION SYSTEMS HAVING REDUCED CORROSION

(75) Inventors: David J. Burkhart, Wentzville, MO (US); Jeffrey T. Kochelek, Creve Coeur, MO (US); Kenneth Jones, Chesterfield, MO (US); Thorstein Holt, Glencoe, MO (US)

(73) Assignee: Engineered Corrosion Solutions, LLC, St. Louis, MO (US)

( * ) Notice: Subject to any disclaimer, the term of this patent is extended or adjusted under 35 U.S.C. 154(b) by 174 days.

(21) Appl. No.: 12/210,555

(22) Filed: Sep. 15, 2008

(65) Prior Publication Data

US 2010/0065287 A1 Mar. 18, 2010

(51) Int. Cl.

| | |
|---|---|
| ***A62C 35/58*** | (2006.01) |
| ***A62C 35/60*** | (2006.01) |
| ***A62C 35/62*** | (2006.01) |
| ***A62C 35/64*** | (2006.01) |

(52) U.S. Cl.

CPC ..... *A62C 35/58* (2013.01); *A62C 35/60* (2013.01); *A62C 35/62* (2013.01); *A62C 35/64* (2013.01); *A62C 35/645* (2013.01)

(58) Field of Classification Search

CPC ..... A62C 35/62; A62C 35/64; A62C 35/645; A62C 35/68; A62C 35/58; A62C 35/60

USPC ..... 169/5–9, 14–18; 34/406, 433

See application file for complete search history.

(56) References Cited

U.S. PATENT DOCUMENTS

| | | | | |
|---|---|---|---|---|
| 2,187,906 | A | | 1/1940 | Lowe |
| 3,905,424 | A | | 9/1975 | Elwood et al. |
| 4,991,655 | A | | 2/1991 | McHugh |
| 5,611,218 | A | | 3/1997 | Naumovitz |
| 5,803,180 | A | * | 9/1998 | Talley ..... 169/16 |
| 6,024,116 | A | | 2/2000 | Almberg et al. |
| 6,076,278 | A | | 6/2000 | Bradley |
| 6,221,263 | B1 | | 4/2001 | Pope et al. |

(Continued)

FOREIGN PATENT DOCUMENTS

| | | |
|---|---|---|
| DE | 3938394 | 5/1991 |
| DE | 3938394 A1 | 5/1991 |

(Continued)

OTHER PUBLICATIONS

Engineered Corrosion Solutions, Ejector Automatic Air Vent product information, 3 pages, Mar. 20, 2009.

(Continued)

*Primary Examiner* — Jason Boeckmann

(74) *Attorney, Agent, or Firm* — Harness, Dickey & Pierce, P.L.C.

(57) ABSTRACT

A fire protection system comprising at least one sprinkler, a source of pressurized water, a piping network connecting at least one sprinkler to the source of pressurized water, and a nitrogen generator coupled to the sprinkler system. The nitrogen generator may be a nitrogen membrane system or a nitrogen pressure swing adsorption system. The present systems and methods reduce or nearly eliminate corrosion that typically affects conventional fire protection systems, such as caused by oxygen and microbial systems, which can deteriorate or compromise function. Initial, repeated, or continuous displacement of oxygen with nitrogen in the fire protection system significantly reduces or eliminates corrosion.

9 Claims, 2 Drawing Sheets

(56) References Cited

U.S. PATENT DOCUMENTS

| | | | | |
|---|---|---|---|---|
| 6,390,203 | B1 * | 5/2002 | Borisov et al. | 169/62 |
| 6,540,028 | B2 * | 4/2003 | Wood | 169/17 |
| 6,581,694 | B2 * | 6/2003 | Golner et al. | 169/66 |
| 6,601,653 | B2 * | 8/2003 | Grabow et al. | 169/16 |
| 6,666,277 | B2 * | 12/2003 | Reilly | 169/16 |
| 6,841,125 | B1 | 1/2005 | Chartier et al. | |
| 6,926,023 | B2 | 8/2005 | Cabral et al. | |
| 6,960,321 | B1 * | 11/2005 | Ludwig | 422/26 |
| 7,066,186 | B2 | 6/2006 | Bahr | |
| 7,104,336 | B2 * | 9/2006 | Ozment | 169/44 |
| 7,322,423 | B2 * | 1/2008 | Ringer | 169/17 |
| 7,389,824 | B2 | 6/2008 | Jackson | |
| 7,594,545 | B2 * | 9/2009 | Love | 169/45 |
| 7,673,694 | B2 * | 3/2010 | Wagner et al. | 169/11 |
| 7,717,776 | B2 * | 5/2010 | Wagner et al. | 454/369 |
| 2007/0000258 | A1 | 1/2007 | Bonaquist et al. | |
| 2007/0114046 | A1 * | 5/2007 | Munroe | 169/16 |
| 2008/0060215 | A1 | 3/2008 | Reilly et al. | |
| 2008/0060216 | A1 * | 3/2008 | Reilly et al. | 34/413 |
| 2010/0263882 | A1 * | 10/2010 | Bodemann | 169/17 |
| 2011/0094758 | A1 | 4/2011 | Burkhart | |
| 2011/0226495 | A1 | 9/2011 | Burkhart et al. | |

FOREIGN PATENT DOCUMENTS

| | | | |
|---|---|---|---|
| EP | 1074276 | | 7/2000 |
| EP | 1074276 | A2 | 2/2001 |
| GB | 1081293 | | 8/1967 |
| JP | 10234881 | A * | 9/1998 |
| JP | 2008-073277 | | 4/2008 |
| JP | 2008073227 | | 4/2008 |

OTHER PUBLICATIONS

Engineered Corrosion Solutions, Ejector Automatic Air Vent product information, 3 pages, Jul. 15, 2008.

O'Keefe Controls Co., Metal Orifice Assemblies product information, 6 pages, 2006.

Compressed Gas Technologies, Nitrogen Generator Specialists, 2009; 1 page; Retrieved online on Mar. 27, 2009 at http://ww.nitrogen-generators.com.

On Site Gas Systems, Copyright 2009; 2 pages; Retrieved online on Mar. 27, 2009 at http://www.onsitegas.com.

Potter Electric Signal; Sprinkler Monitoring Training Manual; National Fire Protection Association [NFPA] and National Electric Manufactures Association [NEMA]; 46 pages; Retrieved online on Mar. 27, 2009 at http://pottersignal.com/spinkler_datasheets.aspx.

General Air Products; Dry Air Pac FM Approved Compressor Dryer Package for Critical Applications from Generators; Copyright 2009; 4 pages; Retrieved online on Mar. 27, 2009 at http://www.generalairproducts.com/fireprotection/content/view/16/88/.

General Air Products; Desiccant Dryers; 2 pages; Retrieved online on Mar. 27, 2009 at http:/www.generalairproducts.com/pages2/desiccant-dryers.html.

Ansul Incorporated, Aquasonic™ Water-Atomizing Fire Suppression System, Data/Specifications, 4 pgs (2008).

Office Action issued Dec. 19, 2012, for corresponding European Patent Application No. 09 792 263.7 entitled Fire Protection Systems Having Reduced Corrosion.

* cited by examiner

FIRE PROTECTION SYSTEMS HAVING REDUCED CORROSION

BACKGROUND

The present technology relates to fire protection systems, such as sprinkler systems.

A fire protection system, also known as a fire suppression or fire sprinkler system, is an active fire protection measure that includes a water supply to provide adequate pressure and water flow to a water distribution piping system, where the water is discharged via sprinklers or nozzles. Fire protection systems are often an extension of existing water distribution systems, such as a municipal water system or water well or water storage tank. The deterioration of piping, sprinkler heads, and hydraulics (the ability of the system to deliver water to design specifications) in fire protection systems can be attributed to the quality of the water being supplied from the water distribution source and corrosion of metallic components including ferrous metals and cuprous metal components within the system.

Deterioration and corrosion of fire protection systems may involve several factors. First, oxidative attack of the metal can produce corrosion deposits, or tubercles, that may partially block a water pipe thereby reducing the hydraulic capacity, requiring higher operating pressures and reducing fire protection. Or, in some cases, tubercles may fully block a water pipe or sprinkler head. Second, depletion of biocide in the water (originally applied by the municipal water supplier or water well or water storage tank) due to the presence of tuberculation, organic matter, and microbiological organisms associated therewith may result in microbiological growth. And third, leaks can result from general corrosion and/or microbiologically influenced corrosion, such as oxidation by trapped air, and the use of higher operating pressures. These factors may operate together to severely compromise the performance of the fire protection system.

Microbiological influenced or induced corrosion (MIC) can result when waterborne or airborne microbiological organisms, such as bacteria, molds, and fungi, are brought into the piping network of the protection system with untreated water and feed on nutrients within the piping system. These organisms establish colonies in the stagnant water within the system which can occur even in dry pipe sprinkler networks where significant amounts of residual water may be present in the piping network after a test or the activation of the system. Over time, the biological activities of these organisms cause significant problems within the piping network. Both ferrous metal and cuprous metal pipes may suffer pitting corrosion leading to pin-hole leaks. Iron oxidizing bacteria form tubercles, which can grow to occlude the pipes. Tubercles may also break free from the pipe wall and lodge in sprinkler heads, thereby blocking the flow of water from the head either partially or entirely. Even stainless steel is not immune to the adverse effects of MIC, as certain sulfate-reducing bacteria are known to be responsible for rapid pitting and through-wall penetration of stainless steel pipes.

Corrosion within a fire protection system can also occur or can increase following operation or testing of the system. For example, when the piping of a dry pipe or preaction sprinkler system is drained after testing, residual water collects in piping low spots and moisture is also retained in the atmosphere within the piping. This moisture, coupled with the oxygen available in the compressed air in the piping, increases the pipe internal wall corrosion rate, possibly leading to leaks. Oxygen and microbiological organisms also contribute to the internal pipe wall corrosion rate in wet pipe systems in which the piping is maintained full of stagnant water providing a medium in which the organisms can grow.

In addition to MIC, other forms of corrosion are also of concern. For example, the presence of water and oxygen within the piping network can lead to oxidative corrosion of ferrous materials. Such corrosion can cause leaks as well as foul the network and sprinkler heads with iron oxide particles (e.g., rust particles) in the form of hematite ($Fe_2O_3$) or magnetite ($Fe_3O_4$), deteriorating the system hydraulics. Presence of water in the piping network having a high mineral content can also cause mineral scale deposition, as various dissolved minerals, such as calcium, magnesium, and zinc, react with the water and the pipes to form mineral deposits on the inside walls. In the presence of dissolved oxygen, these deposits can act to accelerate corrosion of the pipe just beneath the deposits. These deposits can inhibit water flow or can break free and clog sprinkler heads, preventing proper discharge of water in the event of a fire.

A need, therefore, exists in water-based fire protection systems for methods that reduce corrosion of the fire sprinkler system and deterioration of the fire protection system's performance.

SUMMARY

The present technology includes fire protection systems and methods of reducing corrosion in fire protection systems. A fire protection system includes a sprinkler system that comprises at least one sprinkler, a source of pressurized water, a piping network connecting at least one sprinkler to the source of pressurized water, and a nitrogen generator coupled to the sprinkler system. The nitrogen generator may be a nitrogen membrane system or a nitrogen pressure swing adsorption system. The present systems and methods reduce or nearly eliminate corrosion that typically affects conventional fire protection systems, which can deteriorate or even compromise function.

Corrosion in the fire protection system is reduced by displacing oxygen within the system using nitrogen from the nitrogen generator. Displacing oxygen with nitrogen includes filling the piping network of the sprinkler system with pressurized nitrogen from the nitrogen generator. The pressurized nitrogen thereby displaces air, which contains about 21% oxygen, out of the piping. Displacing oxygen with nitrogen can also include filling the piping network with water from the source of pressurized water and providing nitrogen from the nitrogen generator into the water as it fills or is contained in the piping network. The nitrogen added to the water thereby forces dissolved oxygen out of the water into the gas phase which can be continuously and automatically vented out of the system through vents that are specifically designed to remove the trapped gasses from the system.

The fire protection system can include a sprinkler system that is a dry pipe system or a wet pipe system. The dry pipe sprinkler system includes a dry pipe valve or an electrically or mechanically controlled valve coupling the source of pressurized water to the piping network. The nitrogen generator is operable to pressurize the piping network with nitrogen and maintain the dry pipe valve in a closed position until the fire protection system is actuated or to fill the piping system network of preaction sprinkler systems. The wet pipe sprinkler system has the piping network filled with water from the pressurized water source, where the nitrogen generator provides nitrogen into the water when the water enters or is contained in the piping network.

In some cases, the sprinkler system further includes a vent positioned within the piping network. The vent allows gas such as air and oxygen that is displaced by pressurized nitrogen or the pressurized nitrogen itself to exit the piping network. The fire protection system may be tested by flowing water into or through the sprinkler system. After testing, oxygen is again displaced with nitrogen by filling the piping network with pressurized nitrogen from the nitrogen generator and/or filling the piping network with water from the source of pressurized water and providing nitrogen from the nitrogen generator into the water as it fills and/or while it is contained in the piping network.

DRAWINGS

The present technology will become more fully understood from the detailed description and the accompanying drawings.

Figure 1:
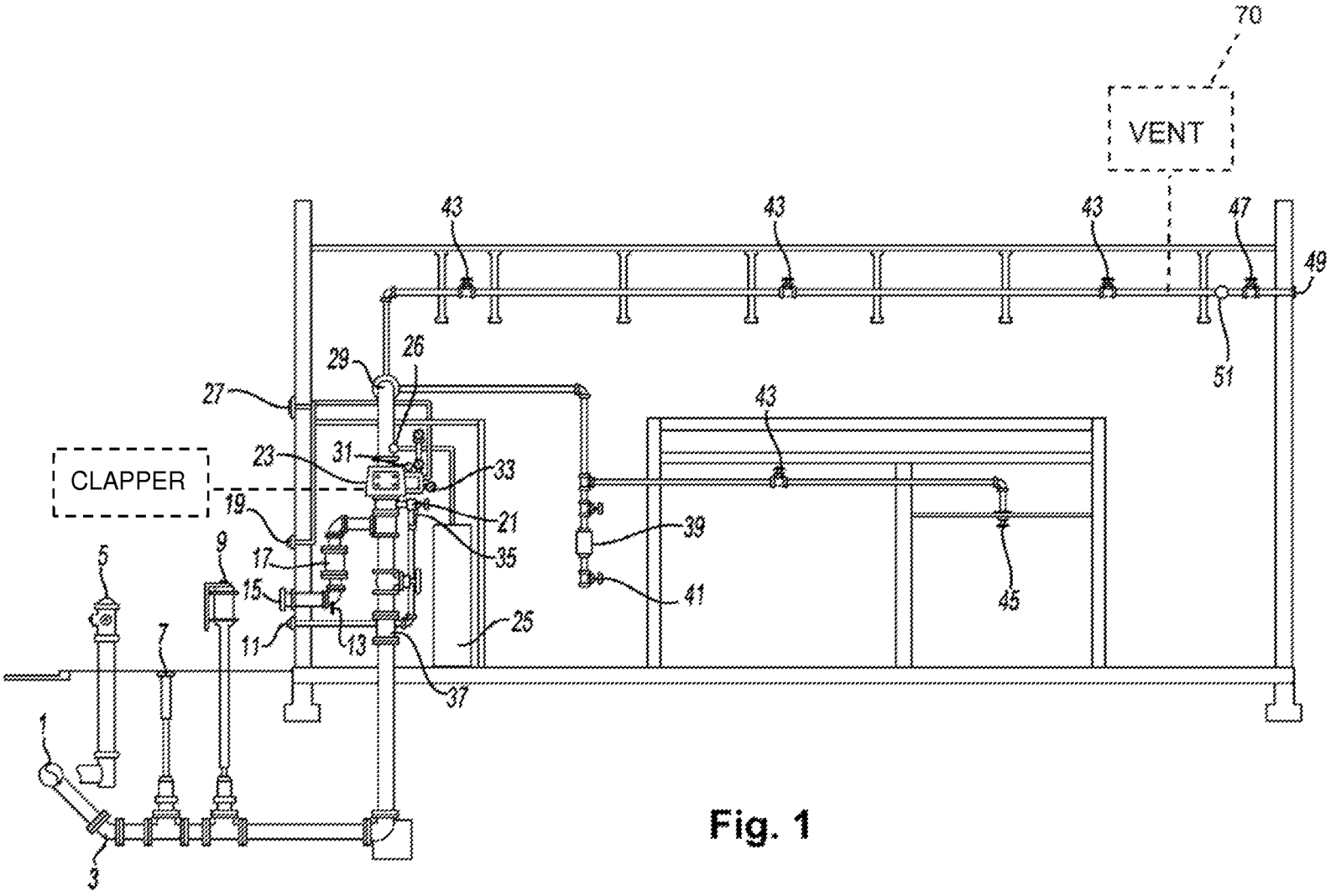
FIG. 1 illustrates a fire protection system constructed in accordance with the present teachings that includes a dry pipe sprinkler system.

It should be noted that the figures set forth herein are intended to exemplify the general characteristics of apparatus, systems and methods among those of the present technology, for the purpose of the description of specific embodiments. These figures may not precisely reflect the characteristics of any given embodiment, and are not necessarily intended to define or limit specific embodiments within the scope of this technology.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

As referred to herein, all compositional percentages are by weight of the total composition, unless otherwise specified. As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

Fire protection systems include a sprinkler system having at least one sprinkler, a source of pressurized water, and a piping network connecting the sprinkler(s) to the source of pressurized water. The present technology uses a nitrogen generator coupled to the sprinkler system to reduce corrosion in the fire protection system. Oxygen dissolved in water or present in air within the fire protection system is displaced with nitrogen from the nitrogen generator in order to reduce or eliminate effects of oxidative corrosion of ferrous and cuprous components and to deprive aerobic microbiological organisms the opportunity to grow within the system. The present fire protection systems and methods for reducing corrosion use the nitrogen generator to displace all or substantially all of the oxygen within the system. Oxygen within the fire protection system may be in the form of pressurized air, trapped air, including trapped air pockets within a water-filled piping network, or may be dissolved within the water. The rate of corrosion in the system is significantly reduced or eliminated by displacing oxygen with noncorrosive nitrogen, since oxygen is often the primary corrosive specie within the system.

The fire protection system should be designed by qualified design engineers in conjunction with recommendations from the insuring bodies and in view of appropriate building codes and industry standards. For example, sprinkler systems are engineered to meet the standards of the National Fire Protection Association (Quincy, Mass. USA; see N.F.P.A. Pamphlet 13, "Standard for The Installation of Sprinkler Systems"), Factory Mutual (F.M.), Loss Prevention Council (Johnston, R.I., USA), Verband der Sachversicherer (Köln, Germany), or other similar organizations, and also comply with the provisions of governmental codes, ordinances, and standards where applicable. Common examples of fire protection systems include dry pipe sprinkler systems, including a subset of dry pipe systems known as preaction systems, and wet pipe sprinkler systems.

A dry pipe sprinkler system is a fire-protection system that utilizes water as an extinguishing agent. The system includes piping from a dry pipe valve to fusible sprinklers that is filled with pressurized gas. A dry pipe system is primarily used to protect unheated structures or areas where the system is subject to freezing temperatures. The structure must be substantial enough to support the system piping when it is filled with water. An alarm may be provided by a main alarm valve. In conventional dry pipe sprinkler systems, pools of residual water are often left from initial hydrostatic testing, from periodic flow testing, or from condensation of moist air that is used to maintain system pressure. The piping of a conventional system is typically pressurized with air and held at 10-40 psi so that residual water in the piping is also saturated with oxygen, where the amount of dissolved oxygen available is based on water chemistry and pressure and is usually in the range of 10-20 parts per million (ppm).

In the case of the dry pipe system, the present systems and methods use nitrogen to fill the piping void space to pressurize the piping and to mitigate the corrosion of the ferrous and cuprous metal components. Nitrogen is used to pressurize the system, purge the initial quantities of nitrogen and other gases trapped in the piping through one or more vent points in the fire sprinkler system in order to dry the system, and to allow the quantity of nitrogen in the piping to increase and ultimately approach about 95% or more. The dew point of 95% nitrogen is approximately −71° F., and as such the nitrogen will absorb any moisture in the piping that may exist from hydrostatic testing or from condensation of saturated compressed air that had previously filled the pipe. The process of venting the nitrogen/air mixture will absorb water and carry it out of the system through the vent point(s), leaving the system in a significantly dryer state.

As further applied, the present systems and methods are very useful in dry pipe sprinkler systems employed in freezer or refrigerator applications or in environments where water may freeze. In environments where water may freeze, ice blocks can form in the piping network when compressed air containing or saturated with water is used to pressurize the piping. As the moisture in the compressed air condenses in the piping, the water freezes to form ice that may restrict flow or even create an ice block or dam within the piping, preventing further gas or water flow altogether. Regenerative desiccant dryers or membrane dryers have been employed to prevent ice blocks from forming. Flushing and purging with 90% or greater nitrogen, with its low dew point, eliminates the need for the regenerative desiccant or other types of air dryers. What is more, due to the difficulty of completely removing residual water from a complex sprinkler system, the use of dry air for drying the pipe will not prevent or significantly reduce corrosion in remaining water filled areas or areas containing residual liquid water or water vapor which might later condense to form liquid water. If dry nitrogen is used as the drying medium, oxygen will be removed along with the water and water vapor and the corrosion will be substantially reduced or eliminated.

A wet pipe sprinkler system provides fixed fire protection using piping filled with pressurized water supplied from a dependable source. Closed heat-sensitive automatic sprinklers (e.g., fusible sprinklers) spaced and located in accordance with recognized installation standards are used to detect a fire. Upon operation, the sprinklers distribute the water over a specific area to control or extinguish the fire. As the water flows through the system, an alarm is activated to indicate the system is operating. Typically, only those sprinklers immediately over or adjacent to the fire operate in order to minimize water damage. In conventional wet pipe sprinkler systems, the water pressure can be in excess of 90 psi, with the water typically saturated with oxygen, thereby providing at least 35 ppm of dissolved oxygen available for corrosion reactions of ferrous and cuprous components. The present systems and methods displace this dissolved oxygen in the source water as the water fills or is contained in the wet pipe sprinkler system.

The wet pipe sprinkler system may be installed in any structure not subject to freezing in order to automatically protect the structure, contents, and personnel from loss due to fire. The structure must be substantial enough to support the piping system when filled with water. In some cases, small unheated areas of a building may be protected by a wet system if an antifreeze-loop or auxiliary dry system is installed.

In the case of the present wet pipe systems, nitrogen is dissolved within the water used to fill the system in order to displace dissolved oxygen and trapped air. For example, nitrogen can be added into the water used to fill the system by using a sparger. The addition of nitrogen displaces any dissolved oxygen within the water and addition of nitrogen may also be used to purge trapped air pockets. In this way, trapped air and oxygen are forced out of one or more vents.

There are several factors that can affect corrosion of a fire protection system. These factors include the nature of the materials used in construction of the system and their susceptibility to oxidation. The source water may include biological contaminants, dissolved and/or solid nonbiological contaminants, trapped air, and dissolved gases. The system can be in constant contact with liquid water, as is the case for a wet pipe system, or the system can be in intermittent contact with liquid water, as is the case for a dry pipe or preaction system when actuated for routine testing or servicing or when activated by a fire. In some cases, once started the corrosion process permits or accelerates further corrosion; for example, the corrosion by-product (e.g. iron oxide) may be shed, sloughing off to expose new metal (e.g., iron) to oxidation. These factors and combinations of these factors can corrode the fire protection system, deteriorating its performance, or even resulting in system failure.

Fire protection systems are often constructed using ferrous and cuprous metallic pipes and fittings. Pipe materials typically come from the manufacturer or distributor with all of the associated open-air corrosion on the internal and external walls. This can include but is not limited to: iron oxide mill scale caused during the manufacturing process by condensation of water on the metal surfaces and the subsequent generalized oxygen corrosion that results from oxygen attack, the metal loss is typically minimal with no significant pitting; debris from the storage yard on the threads and in the ends of the pipe; and the presence of other solids associated with outside storage, such as spider webs, dead bugs, etc. After or during the installation of the pipe, additional sources of debris and fouling may end up inside the assembled network of piping, including: residual cutting oil from the thread cutting process during installation; metal filings from the thread cutting process during installation; various forms of hydrocarbon based thread lubricants; and Teflon® tape used in assembly of the pipe fittings.

The source water used in fire protection systems is generally from a fresh potable water source with very low total dissolved solids (TDS). The water is generally saturated with oxygen from the atmosphere and contains very little, if any, insoluble suspended solids. It may also contain small (less than about 2 ppm) amounts of residual chlorine from municipal treatment at the source. The water may not contain any detectable levels of microorganisms, however, this does not preclude the presence of microorganisms, as they will simply be difficult to detect at the low levels that exist in the potable water.

Once installed, at least a portion of the fire protection system is filled and charged with water. In the case of a dry pipe system, the piping network is filled with water upon routine testing or following activation. As the source water fills the piping, all of the debris that is clinging to the interior walls will become mobilized. Materials that are insoluble in water (solids) will generally sink to settle and collect in all of the low spots within the system due to gravity. For example, in long runs of horizontal piping, the solids will collect at the six o'clock position, when viewing a pipe in cross-section. Any hydrocarbon within the system will float on the water and will tend to agglomerate (i.e., oil wet) any insoluble particulates that are contacted. It is also difficult to completely remove all of the air during the water charging process. Whatever air is left in the system creates pockets within the pipes and results in a discrete air/water interface. As the system is pressurized, air will also dissolve into the water and quickly reach a state of equilibrium.

Oxygen corrosion may be the predominant form of corrosion and metal loss within the fire protection system. Air contains approximately 21% oxygen, and unless the source water is mechanically deaerated to effect oxygen removal, it will generally contain about 8-10 ppm of dissolved oxygen when it first enters the piping. The oxygen will immediately react with any free iron it contacts on the pipe walls according to the following equations:

Anodic Reaction: $Fe^0 \rightarrow Fe^{++} + 2e^-$

Cathodic Reaction: $\frac{1}{2}O_2 + H_2O + 2e^- \rightarrow 2OH^-$

Electrochemical Reaction: $Fe^0 + \frac{1}{2}O_2 + H_2O \rightarrow Fe(OH)_2\downarrow$ The initial fill of water will remove iron from the pipe walls and some small level of metal loss will occur. The metal loss will be most acute at the air/water interface where the dissolved oxygen content will be the highest. The soluble iron that is liberated from the pipe walls at the interface will almost immediately precipitate as iron oxide, probably as ferric oxide, commonly known as rust. The iron oxide may adhere to the pipe wall for a time, just below the air/water interface, but because of the loose, non-adhesive nature of the deposit, it is highly likely that the iron oxide will slough off and settle to the bottom of the pipe. Even slight turbulence or disturbances in the pipe network will cause the deposit to be shed, exposing new free iron for attack by oxygen. As the air-water-metal environment stagnates, the oxygen will be consumed and corrosion will slow down. If left undisturbed, the system could remain at a low general corrosion rate for a long period of time.

Several factors may accelerate or continue corrosion of the system, however. These include: addition of more oxygen, solids (e.g., iron oxides, particulate matter, etc.), growth of microbiological organisms, mechanical deposit removal, and draining and refilling the system, including testing or actuating the system. Any oxygen that enters the system will affect the equilibrium that exists between iron, water, and oxygen. More oxygen will cause additional free iron loss and create more solids by precipitating iron oxides. The metal loss at the air/water interface will once again become the site producing the most reaction and subsequent corrosion.

Solids accelerate corrosion by several mechanisms. Under-deposit acceleration may occur wherein the area under the solid achieves an anodic-character versus the adjacent metal. This anodic-character will mean that corrosion will be more aggressive under the deposit and pitting will occur. In oxygenated systems, the area under the deposit can become oxygen-depleted and can achieve anodic-character versus the adjacent metal. Once again, the corrosion under the deposit will become more aggressive and pitting will occur. Solids also provide an ideal environment for microbiological organisms, such as bacteria, to colonize. In addition, depending on the chemical make-up, the solids may serve as nutrient sources for the bacteria. Slimes and deposits that the bacteria create will also act as deposits under which pitting may occur.

There are a myriad of different mechanisms that come under the heading of microbiologically influenced corrosion (MIC). Generally, MIC refers to corrosion that is effected by the metabolic processes of mixed cultures of microorganisms, typically bacteria and fungi. For example, microorganisms can act to influence corrosion in three different ways. First, microorganisms can produce slimes and deposits that accelerate the under-deposit corrosion mechanisms; e.g., oxygen concentration cells in aerobic environments. Second, microorganisms produce metabolic by-products that directly contribute to the corrosion reaction; e.g., organic acid producers that solubilize the iron in mild steel. Third, microorganisms produce metabolic by-products that indirectly contribute to the corrosion reaction by acting as a cathodic depolarizer; e.g., sulfides produced by sulfate-reducing bacteria.

Various bacteria types may be responsible for deterioration and corrosion of fire sprinkler systems. Acid Producing Bacteria (APB) are a variety of heterotrophic anaerobic bacteria that share the common ability to produce weak organic acids. These conditions typically exist under deposits within fire protection systems. As they produce acids, APB cause the pH under the deposit to drop significantly from neutral to acidic with a terminal pH of about 3.5 to about 5.5. These acidic conditions (up to 1000 times more acidic than the source water) are very corrosive and will cause significant metal loss in ferrous metal or cuprous metal components of fire protection systems. Because these acid-producing activities occur under anaerobic conditions, APB can exist as partners in corrosion with sulfate reducing bacteria.

Sulfate-Reducing Bacteria (SRB) are a group of anaerobic bacteria that generate hydrogen sulfide ($H_2S$) as a metabolic by-product of the reduction of sulfate in the water or from a mineral scale deposit. Hydrogen sulfide is a colorless, toxic and flammable gas that is characterized by the typical rotten egg odor which is detectable by humans at about 0.005 ppm in the air. Concentrations of hydrogen sulfide in the air above 800 ppm are lethal to humans. In the presence of soluble iron, the sulfide anion reacts spontaneously to produce iron sulfide, a finely divided black crystal, which can manifest itself as "black water". SRB are difficult to detect because they are anaerobic and tend to grow deep within biofilms (slimes) as a part of a mixed microbial community. SRB may not be detectable in the free-flowing water over the site of the fouling.

Heterotrophic Aerobic Bacteria (HAB) use oxygen to respire as part of their metabolism. They pose problems in fire protection systems by contributing to slime formations on the pipe walls. As the slimes accumulate solids from the system, conditions are created that favor the acceleration of under-deposit corrosion mechanisms.

Iron-Related Bacteria (IRB) are typically divided into two sub-groups e.g., iron-oxidizing and iron-reducing bacteria. IRB use iron in their metabolism to create red colored slimes, "red water" and can produce odor problems in fire protection systems. These bacteria function under different reduction-oxidation (redox) conditions and use a variety of nutrients for growth.

Slime Forming Bacteria (SFB) are able to produce large amounts of slime without necessarily having to use any iron. Iron bacteria also produce slime but usually it is thinner and involves the accumulation of various forms of iron. Slime-forming bacteria generally produce the thickest slime formations under aerobic (oxidative) conditions.

Depending on the type of bacteria that are involved the corrosion rate in the system can be accelerated by the following mechanisms: (1) slime formation—under-deposit pitting corrosion; (2) acid production—acidic pitting corrosion; and (3) sulfide anion production—cathodic depolarization resulting in pitting corrosion.

Mechanical deposit removal can allow additional corrosion. Anytime a corrosion deposit is removed from the metal surface, it creates a new site for attack. This will most often occur at the air/water interface and repeated removal of the deposit will create crevices.

Draining and refilling the system also allows additional corrosion. Each time the system is drained of the fluids and refilled, the high rate of oxygen corrosion that exists with a fresh supply of air will remove a new layer of iron from the pipe walls. Any deposits that exist on the metal surfaces will become oxygen concentration cells in the new oxygen rich fluids and the otherwise low general rate of corrosion will be greatly accelerated and pitting will occur.

The present fire protection systems and methods utilize a nitrogen generator to introduce nitrogen into the system to displace any oxygen. The nitrogen generator can provide nitrogen on-demand to fill and/or purge a system as desired, automatically based on a sensor, such as an oxygen sensor, on a periodic basis, or on a continuous basis. The nitrogen generator is capable of generating a stream of gas having a greater concentration of nitrogen than air, where air is about 78% nitrogen. For example, the nitrogen generator may produce a stream of at least 85%, at least 90%, at least 95%, or at least 99% nitrogen. The nitrogen produced by the nitrogen generator may be supplied to displace oxygen to below detectable limits in the system, or to displace oxygen below a particular threshold within the fire protection system. For example, oxygen may be displaced to where it is less than 20 ppm, less than 15 ppm, less than 10 ppm, less than 5 ppm, or less than 1 ppm.

Nitrogen generators include nitrogen membrane systems and nitrogen pressure swing adsorption systems. A membrane nitrogen generator is a modular system consisting of pre-filtration, separation, and distribution sections. Controls for the system are included in the nitrogen separation unit. Ambient air enters the feed air compressor, which may be an oil injected rotary screw air compressor, via its inlet filter. Air is compressed and travels through an aftercooler and, in many systems, a refrigerated air dryer. Inside the membrane nitrogen generation unit, the first item the feed air comes in contact with is the filtration system, which utilizes a combination of particulate, coalescing, and carbon adsorption technologies. The filters are fitted with automatic condensate drains. Units may be fitted with an air circulation heater and controls, which is installed in the air stream before the nitrogen membrane(s), but after the final filter and pressure regulator. The heater maintains a constant temperature of compressed air to the membranes, enhancing stability and performance.

The nitrogen membrane module(s) are located in the heated air stream. On lower purity systems, such as 99% $N_2$ and below, the membranes are connected in parallel. On higher purity systems, such as 99% $N_2$ or higher, the membranes may be connected in series or using a combination of series and parallel. Slowing down the flow through the membrane separators will automatically give higher nitrogen purity as well. High purity systems have separate permeate connections. One is strictly waste gas, but the second one is a line that can be re-circulated back to the feed compressor intake to enhance purity and productivity. After the air passes through the membrane bundle(s), it is essentially nitrogen plus trace amounts of inert gasses and the specified oxygen content. A built-in flow meter may be installed to constantly monitor nitrogen flow. The nitrogen membrane module(s) may be operated at ambient temperatures as well to eliminate the need for electricity. Operation at reduced temperatures may yield lower productivity or reduced nitrogen purity.

In a pressure swing adsorption (PSA) nitrogen generator the adsorption technology is a physical separation process, which uses the different adsorption affinities of gases to a microporous solid substance, the so-called adsorbent. Oxygen, for example, has a higher adsorption capacity or quicker adsorption time to some carbon molecular sieves compared to nitrogen. This characteristic is used within the PSA process for the generation of nitrogen from air. The main advantages of this process are the ambient working temperature, which results in low stresses to equipment and adsorbent material, and the low specific power consumption.

The PSA-nitrogen generator typically includes the main equipment: air compressor, refrigerant dryer, air receiver tank, two adsorber vessels filled with adsorbent material and a product buffer. Each adsorber operates on an alternating cycle of adsorption and regeneration resulting in a continuous nitrogen product flow. PSA-nitrogen generators may be designed with just one adsorber vessel as well in order to simplify the design.

The PSA-nitrogen generator works according to the following process steps. First is an adsorption step, where compressed and dried air at ambient temperature is fed into the PSA-vessel (adsorber) at the compressor discharge pressure. The adsorber is filled with molecular sieves. The remaining moisture and carbon dioxide in the air are removed at lower layers of the bed and oxygen is adsorbed by the upper molecular sieve filling. The remaining, nitrogen-rich product gas leaves the adsorber at the outlet and is fed to the nitrogen buffer. Before the adsorption capacity for oxygen is depleted, the adsorption process is interrupted so that no oxygen can break through at the adsorber outlet. Second is a regeneration\purge step, where the saturated adsorber is regenerated by means of depressurization and additionally by purging with nitrogen produced by the second adsorber in order to remove the adsorbed gases $H_2O$, $CO_2$, and $O_2$ from the adsorbent bed. The waste gas is vented to the atmosphere. Third is a re-pressurization step, where after regeneration the adsorber is refilled with air and part of the recycled nitrogen. The adsorber is then ready for the next adsorption step.

Suitable nitrogen generators include those available from: Generon IGS (Houston, Tex.), manufacturer of membrane and PSA nitrogen generators; Ingersoll Rand (Montvale, N.J.), manufacturer of membrane and PSA nitrogen generators; On Site Gas (Newington, Conn.), manufacturer of nitrogen and oxygen generators; South Tek Systems (Raleigh, N.C.), manufacturer of nitrogen generators; and Air Products (Allentown, Pa.), manufacturers of nitrogen generators.

In the case of a dry pipe sprinkler system, the nitrogen generator may be used to purge or recharge the pressurized piping network with nitrogen. For example, pressurized nitrogen within the piping network holds the dry pipe valve in the closed position to prevent entry of the pressurized water into the piping network. Any leaks in the sprinkler system may cause a loss of pressure. The nitrogen generator may therefore be used to recharge the pressurized piping network as needed and may be configured to do so automatically. For example, the fire protection system may include a pressure gauge to measure the nitrogen pressure against the dry pipe valve. The nitrogen generator may automatically provide pressurized nitrogen when the pressure gauge drops below a predetermined threshold.

The fire protection system having a dry pipe sprinkler system may also be configured to continuously supply pressurized nitrogen into the piping network using the nitrogen generator. In this case, the nitrogen generator provides a steady stream of pressurized nitrogen into the sprinkler system to keep the dry pipe valve closed. To prevent over-pressurization of the fire protection system components, the system may include a vent such as a relief valve in order to control or limit the pressure in the system. The relief valve allows pressurized nitrogen to escape at a preset or adjustable limit to prevent over-pressurization while maintaining enough pressure within the system to prevent the dry pipe valve from opening. In the event the fire protection system is actuated, due to a fire or for testing, the pressure within the piping network is lost faster than the nitrogen generator can replace it, even when continuously applying pressurized nitrogen, thereby allowing the dry pipe valve to open and pressurized water to enter the piping network.

Continuous venting of the fire protection system using one or more vents or valves facilitates removal of any oxygen within the system while maintaining the required system pressure (of nitrogen) for the fire sprinkler system. In dry or preaction fire sprinkler systems, 95%+ nitrogen gas (dew point of −70° F.) may also be used to dehydrate the system by pulling any water within the system into the dry nitrogen and venting the gas, thereby eliminating residual water and one of the key components in the corrosion reaction. For example, following testing the piping network may contain residual water and the piping network may be dried by purging with pressurized nitrogen.

In the case of a wet pipe sprinkler system, the nitrogen generator may be used to provide additional water containing dissolved nitrogen in order to purge or recharge the piping network. For example, oxygen from the air may over time penetrate the sprinkler system through leaks in the system. Oxygen from the air may enter pockets of gas trapped within the system and/or may dissolve into the water contained within the piping network of the wet pipe sprinkler system. The water can be sparged and vented by bubbling nitrogen through the water column in order to strip the oxygen out of the water to a concentration below 5.0 ppm and with adequate sparging time below 1.0 ppm. At this level in a stagnant fire sprinkler system, oxygen corrosion of ferrous metal of cuprous metal components will be very minimal.

Alternatively, anywhere from a portion of the piping network to the whole piping network may be flushed with fresh water containing dissolved nitrogen. For example, the nitrogen generator may be used to provide nitrogen to the wet pipe sprinkler system as needed, periodically, or continuously. Where the piping network is already filled with water, nitrogen may be bubbled through the piping network to displace oxygen where nitrogen and the displaced oxygen are allowed to exit one or more vents. The vent is operable and positioned to retain the pressurized water within the wet pipe sprinkler system but allows gas to exit. For example, the vent may include a filter or membrane that is gas permeable but liquid impermeable.

The present fire protection systems and methods may further employ one or more oxygen sensors. The oxygen sensor may be used to detect oxygen within the system and trigger the nitrogen generator to purge or flush the system with nitrogen gas, with water and dissolved nitrogen gas, and/or to bubble nitrogen gas through water already within the system. The oxygen sensor may be used to measure effective displacement of oxygen during the initial setup or installation of the system, following actuation or testing of the system, and/or for monitoring of the system while in service. For example, in a dry pipe sprinkler system one or more oxygen sensors may be positioned in the piping network to ascertain whether pressurized nitrogen supplied by the nitrogen generator has effectively displaced oxygen in the system to below a predetermined threshold or to a level where oxygen is no longer detectable. In the case of a wet pipe system, the oxygen sensor may be used to monitor the water within the piping network to ensure oxygen has been effectively displaced and reduced below a desired threshold or is no longer detectable.

The oxygen sensor may be used in an automated system to trigger the nitrogen generator to purge or flush the system or the system may be manually activated based on a reading provided by the oxygen sensor. For example, the oxygen sensor may be coupled to an alarm indicating that oxygen is present or at an undesirable level within the fire protection system. Suitable oxygen sensors include those provided by: GE Sensing—Panametrics (Billerica, Mass.), built in oxygen analyzers; Maxtec (Salt Lake City, Utah), handheld oxygen analyzers; and AMI (Huntington Beach, Calif.), built in oxygen analyzers.

The present fire protection systems and methods for reducing corrosion in fire protection systems may provide several benefits and advantages. Nitrogen displacement of oxygen reduces or eliminates the primary corrosive specie within the aqueous environment that exists in a fire sprinkler system. Nitrogen is applied whenever the system is tested or recharged or following actuation in the event of a fire. For example, each time the fire protection system is breached for annual testing or system modification, nitrogen is added to displace oxygen and prevent new oxygen saturated air and/or water from corroding the piping.

Nitrogen has many beneficial characteristics for use within a fire protection system. It is inert and will not participate, augment, support, or reinforce corrosion reactions. It can be used as a stripping gas to remove oxygen from the water and/or from the void space above the water with adequate venting. If venting is continued, the concentration of oxygen in the water and in the void space can be reduced to near zero. Nitrogen is non-toxic, odorless, colorless, and very "green," as it is not a greenhouse gas and may be generated on site and on-demand from air using a nitrogen generator. Where the fire protection system is coupled to a municipal water supply, with nitrogen there is no concern about toxicity or contamination of the water supply should any backflow occur from the fire protection system to the municipal water, as might be the case with other chemical additives. What is more, any water treated with nitrogen that must be discharged into the municipal sewer system is non-toxic and will contain little or no iron oxide resulting from corrosion of the piping. The present systems and methods using nitrogen also reduce or eliminate oxidation and degradation of elastomeric seats found in valves and other components of the fire protection system.

Nitrogen displacement of oxygen can also serve to inhibit growth of aerobic microbiological organisms within the fire protection system and may even result in death of these organisms. Aerobic forms of microbial contaminants generally pose the greatest risk of creating slimes in fresh water systems. These slimes pose serious risks to fire sprinkler systems because they can impact the hydraulic design of the fire sprinkler system if they form in sufficient quantities as sessile (attached) populations. These slimes can also slough off of the pipe walls and lodge in sprinklers and valves. The present systems and methods substantially reduce or even eliminate growth of these aerobic microbiological organisms and prevent subsequent slime formations.

The present systems and methods employ a nitrogen generator that provides several advantages. Nitrogen generators are a cost-effective means for continuous administration of nitrogen to the fire protection system. They obviate the need for gas cylinder inventory, changing out of gas cylinders, and risks associated with handling gas cylinders. Nitrogen generators only require a compressed air supply to separate atmospheric nitrogen from oxygen.

The present systems and methods can be used in conjunction with other components and methods in order to further reduce corrosion or treat corrosion and the effects of corrosion. For example, fire protection systems can be sterilized to control bacteria using chemical treatments and/or heated gases or liquids. Solids may be eliminated by cleaning and flushing the system. Corrosion can also be reduced in fire protection systems through the application appropriate corrosion inhibiting chemicals that are applied to the water that enters the fire protection system piping.

Corrosion inhibitors are commercially available that can significantly reduce the rate of oxygen corrosion in ferrous and cuprous metals. The corrosion inhibitors are generally proprietary formulations that retard the cathodic half reaction of the corrosion cell. There are also proprietary formulations that can be used to provide biocidal activity wherein the microbes within the fire sprinkler system piping are killed by exposure to toxic levels of the biocidal formulations. These products indirectly reduce the level of corrosion by preventing the proliferation of microorganisms and thereby preventing their corrosion accelerating activities including cathodic depolarization, under-deposit acceleration or organic acid attack of the ferrous or cuprous metallic components. In every instance, the use of nitrogen augments the reduction in corrosion that can be afforded through the use of corrosion inhibiting chemicals or microbiocidal chemicals.

The present technology is further described in the following examples. The examples are illustrative and do not in any way limit the scope of the technology as described and claimed.

Example 1

Dry Pipe System

An embodiment of the present fire protection system comprises a dry pipe sprinkler system. The dry pipe sprinkler system utilizes water as an extinguishing agent. The system piping from the dry pipe valve to the fusible sprinklers is filled with pressurized nitrogen. In some cases, the system is an air check system or further includes an air check system. An air check system is a small dry system which is directly connected to a wet pipe system. The air check system uses a dry valve and a nitrogen generator but does not have a separate alarm. The alarm is provided by the main alarm valve.

A dry pipe system is primarily used to protect unheated structures or areas where the system is subject to freezing. Under such circumstances, it may be installed in any structure to automatically protect the structure contents and/or personnel from loss due to fire. The structure must be substantial enough to support the system piping when filled with water. The system should be designed by qualified design engineers in conjunction with recommendations from insuring bodies.

The dry pipe system may include several components. Although various dry pipe systems constructed according to the present teachings will function in the same manner, the components and arrangements may vary due to the application of different sets of standards. For example, the size and geometry of the fire protection system is based on the particular installation and coverage.

The water supply includes an adequate water supply taken from a city main, an elevated storage tank, a ground storage reservoir and fire pump, or a fire pump taking suction from a well and pressure tank.

Underground components include piping of cast iron, ductile iron or cement asbestos; control valves and/or post indicator valves (PIV); and a valve pit. The valve pit is usually required when multiple sprinkler systems are serviced from a common underground system taking supply from a city main: two OS & Y valves, check valves or detector check, fire department connection (hose connection and check valve with ball drip). Depending on local codes for equipment and building requirements, a back-flow preventer, full-flow meter, or combinations of equipment may be required.

Auxiliary equipment includes fire hydrants with outlets for hose line and/or fire truck use.

Portions of the system inside the structure include the following. A check valve must be incorporated if not already provided in the underground system. A control valve, such as a wall PIV or OS&Y must be incorporated if a control valve is not already provided in the underground piping for each system. A dry pipe valve with the following features: the dry-pipe valve and pipe to the underground system must be protected from freezing, for example, the structure or enclosure should be provided with an automatic heat source, lighting, and sprinkler protection; a nitrogen generator (automatic or manual) capable of restoring nitrogen pressure to the system in 30 minutes or less; an accelerator is required when system capacity exceeds 500 (1892.5 liters) gallons; a water motor alarm or electric pressure switch; and valve trim and pressure gauges.

Fire department connection to the system is provided by a hose connection and check valve with a ball drip, if it is not already provided as part of the underground components.

The system piping progressively increases in size in proportion to the number of sprinklers from the most remote sprinkler to the source of supply. The pipe size and distribution is determined from pipe schedules or hydraulic calculations as outlined by the appropriate standard for the hazard being protected.

Sprinklers include various nozzles, types, orifice sizes, and temperature ratings, as known in the art. Sprinklers installed in the pendent position must be of the dry pendant type when the piping and sprinkler are not in a heated area that may be subject to freezing temperatures. Sprinklers are spaced to cover a design-required floor area.

The system includes an inspector's test and drain components. A test drain valve must be provided. All piping is pitched toward a drain. A drain is provided at all low points. A two-valve drum drip may be required. An inspector's test is required on each system. The inspector's test simulates the flow of one sprinkler and is used when testing the system to ensure that the alarm will sound and the water will reach the farthest point of the system in less than one minute.

The system includes various pipe hangers as needed.

The point of incorporation for the nitrogen discharge from the nitrogen generator is at a point just above the dry pipe valve on the main riser. The point of entry into the piping is a pipe equipped with a check valve to prevent backflow to the nitrogen generator.

One or more oxygen sensors are positioned in the piping network. The oxygen sensor(s) is positioned at or near the end of a length of pipe in the piping network. In this way, when the piping network is filled with pressurized nitrogen for service or when the piping network is purged with nitrogen for drying after testing or actuation, the oxygen sensor is used to ensure that all or an appropriate level of oxygen is displaced as the nitrogen stream is allowed to exit a terminal vent within the piping network.

The fire protection system operates as follows. When a fire occurs, the heat produced will operate a sprinkler causing the nitrogen pressure in the piping system to escape. When the pressure trip-point is reached (directly or through the accelerator), the dry-pipe valve opens allowing water to flow through the system piping and to the water motor alarm or electric pressure switch to sound an electric alarm. The water will continue to flow and the alarm will continue to sound until the system is manually shut off. A dry-pipe valve equipped with an accelerator will trip more rapidly and at a higher air-pressure differential. Component parts of the dry-pipe system operate in the following manner.

The dry valve operates as follows. When the nitrogen pressure in the dry system has dropped (from the fusing of an automatic sprinkler) to the tripping point of the valve, the floating valve member assembly (air plate and water clapper) is raised by the water pressure trapped under the clapper. Water then flows into the intermediate chamber, destroying the valve differential. As the member assembly rises, the hook pawl engages the operating pin which unlatches the clapper. The clapper is spring-loaded and opens to the fully opened and locked position automatically.

The accelerator operates on the principal of unbalanced pressures. When the accelerator is pressurized, nitrogen enters the inlet, goes through the screen filter into the lower chamber and through the anti-flood assembly into the middle chamber. From the middle chamber the nitrogen slowly enters the upper chamber through an orifice restriction in the cover diaphragm. In the SET position the system nitrogen pressure is the same in all chambers. The accelerator outlet is at atmospheric pressure. When a sprinkler or release operates, the pressure in the middle and lower chambers will reduce at the same rate as the system. The orifice restriction in the cover diaphragm restricts the nitrogen flow from the upper chamber causing a relatively higher pressure in the upper chamber. The pressure differential forces the cover diaphragm down pushing the actuator rod down. This action vents the pressure from the lower chamber to the outlet allowing the inlet pressure to force the clapper diaphragm open. The pressure in the accelerator outlet forces the anti-flood assembly closed, preventing water from entering the middle and upper chambers. On a dry pipe system, the nitrogen pressure from the accelerator outlet is directed to the dry pipe valve intermediate chamber. As the nitrogen pressure increases in the intermediate chamber, the dry valve pressure differential is destroyed and the dry valve trips allowing water to enter the dry pipe system. On a pneumatic release system, the outlet pressure is vented to atmosphere, speeding the release system operation.

With reference to FIG. 1, the city main 1 provides pressurized water to the underground fire main 3 and to a fire hydrant 5. A key valve 7 is used to control flow of water into the underground fire main 3 and a post indicator valve 9 can measure pressure. The system also includes a test drain 11, a ball drip 13, and a fire department connection 15. A check valve 17 positioned near the fire department connection 15 prevents backflow into the system. A water motor alarm drain 19 runs from the water motor alarm 27 and a test drain valve 21 controls flow to the test drain 11. A dry pipe valve 23 controls pressurized water flow from the underground fire main 3 to the cross main 29 and the piping network in response to pressurized nitrogen within the piping network. A nitrogen generator 25 is connected past the dry pipe valve 23 on the cross main 29 and piping network side and uses a check valve 26 to prevent backflow into the nitrogen generator 25. A pressure maintenance device 31 is used to measure nitrogen pressure in the piping network. An alarm test valve 33 and drain cup 35 can be used for testing. Another check valve 37 is positioned to prevent backflow from the system into the underground fire main 3. A drum drip 39 and drain valve and plug 41 are positioned in the piping network. One or more upright sprinklers 43 and pendent sprinklers 45 are positioned and spaced within the piping network to provide fire protection coverage. An inspector's test valve 47 and an inspector's test drain 49 are positioned at a terminal portion of the piping network to allow testing and purging of the system. One or more oxygen sensors 51 are positioned near the inspector's test valve 47 and inspector's test drain 49, adjacent to system vents 70 and at other terminal portions of the piping network, to measure oxygen and ensure all oxygen or an acceptable level of oxygen is purged from the system.

Example 2

Wet Pipe System

An embodiment of a fire protection system comprises a wet pipe sprinkler system. The wet pipe system may include several components; however, various wet pipe systems constructed according to the present teachings will function in the same manner, and the components and arrangements may vary due to the application of different sets of standards. For example, the size and geometry of the fire protection system is based on the particular installation and coverage.

The wet pipe sprinkler system provides fixed fire protection using piping filled with pressurized water supplied from a dependable source. Closed heat sensitive automatic sprinklers, spaced and located in accordance with recognized installation standards, detect a fire. Upon operation, the sprinklers distribute the water over a specific area to control or extinguish the fire. As the water flows through the system, an alarm is activated to indicate the system is operating. Only those sprinklers immediately over or adjacent to the fire operate, minimizing water damage.

A wet pipe sprinkler system may be installed in any structure not subject to freezing in order to automatically protect the structure, contents, and/or personnel from loss due to fire. The structure must be substantial enough to support the piping system when filled with water. Using water as its extinguishing agent, one wet system may cover as much as 52,000 square feet in a single fire area. The system should be designed by qualified fire protection engineers in conjunction with insuring bodies. Sprinkler systems are engineered to meet provisions of governmental codes, ordinances, and standards where applicable. Small unheated areas of a building may be protected by a wet system if an antifreeze-loop or auxiliary dry system is installed.

The nitrogen discharge from the nitrogen generator is at a point just above the wet pipe alarm valve on the main riser. The point of entry into the piping will be a pipe equipped with a check valve to prevent backflow to the nitrogen generator. The injection pipe protudes through the main riser pipe to the center of the pipe at which point a sparging element (e.g., fritted steel) may be attached to the pipe to allow micro dispersion (i.e., sparging) of millions of nitrogen gas bubbles into the water. A sparging device may or may not be required to adequately strip the dissolved oxygen out of the water with the nitrogen gas. A simple injection quill may be sufficient to bubble the nitrogen through the water although it would not be as efficient in removing the dissolved oxygen in the water.

One or more oxygen sensors are positioned in the piping network. The oxygen sensor(s) is positioned at or near the end of a length of pipe in the piping network. In this way, when the piping network is placed in service and filled with water that is bubbled with nitrogen to displace oxygen, or when the piping network is purged or flushed for testing, the oxygen sensor is used to ensure that all or an appropriate level of oxygen is displaced from within the system as the nitrogen-laden water flows through the piping network. Pressurized water containing nitrogen can be allowed to exit terminal valves, such as an inspector's valve, or via a sprinkler used for testing or as a valve.

The wet pipe sprinkler system operates as follows. In the normal set condition, the system piping is filled with water that is saturated or nearly saturated with nitrogen. For example, as the water fills the system it can be sparged with nitrogen and/or nitrogen may be added to an already water-filled system by directing nitrogen through the piping and venting gas including purged air/oxygen.

When a fire occurs, the heat operates a sprinkler allowing the water to flow. The alarm valve clapper is opened by the flow of water allowing pressurized water to enter the alarm port to activate the connected alarm devices. When using a variable pressure water supply, the water flowing through the alarm port overcomes the retard chamber's drain restriction, filling the retard chamber then activating the connected alarm devices. The alarms will continue to sound until the flow of water is manually turned off.

The normal conditions for the wet pipe system include the following. All water supply control valves are open and secured. Alarm test shut-off valve is in ALARM position. The water gauge valves are open. The water supply pressure gauge (lower gauge) equals that of the known service-line pressure. The system pressure gauge (upper gauge) reading is equal to or greater than the water supply pressure gauge reading. Incoming power to all alarm switches is on. Main-drain valve, auxiliary drain valves, and inspectors test valves are closed. The sprinkler head cabinet contains appropriate replacement sprinklers and wrenches. Temperature is maintained above freezing for entire system. If the fire department connection is used, make sure the automatic drip valve is free, allowing accumulated water to escape. The sprinklers are in good condition and unobstructed.

Figure 2:
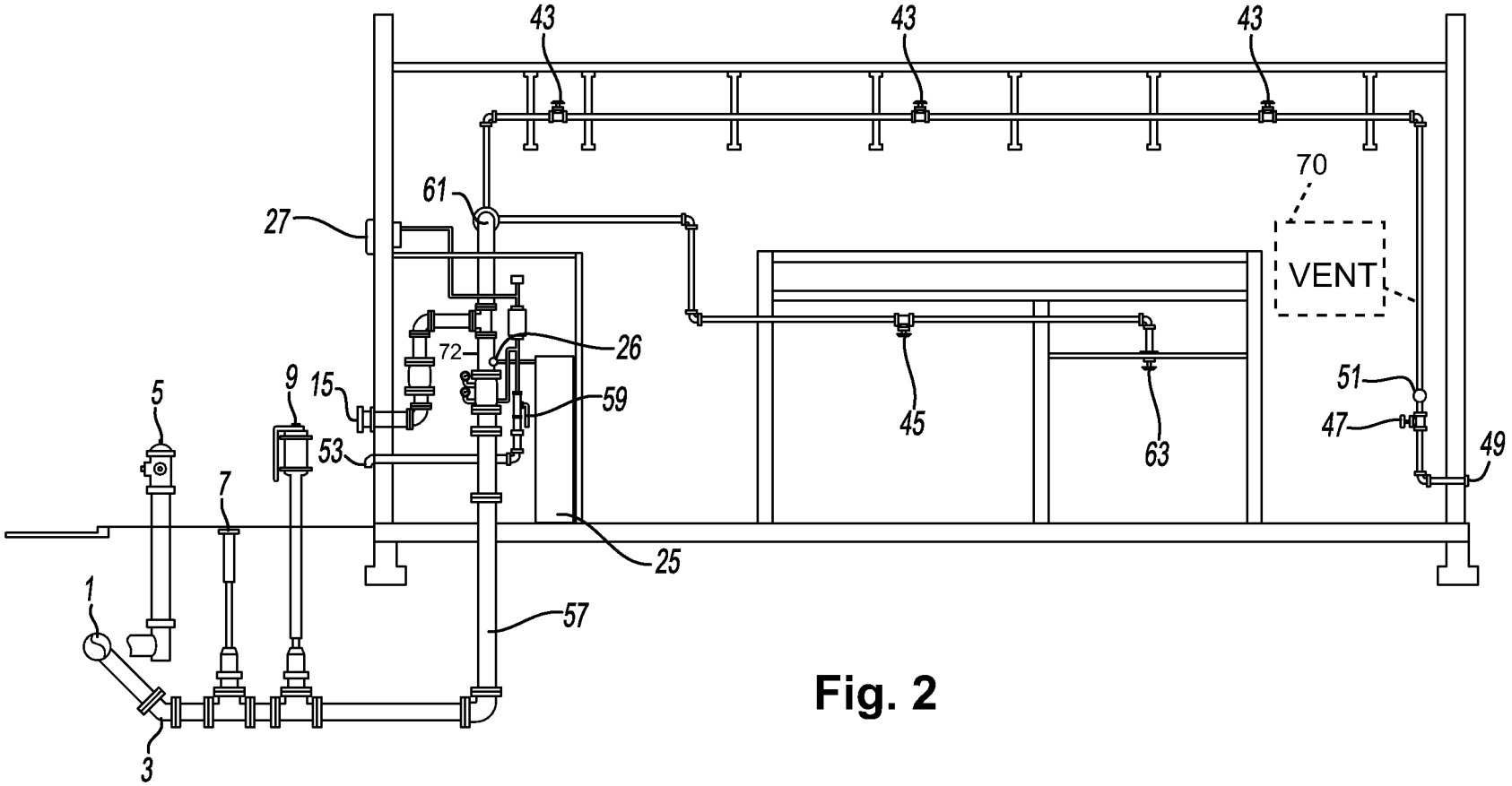
FIG. 2 illustrates a fire protection system constructed in accordance with the present teachings that includes a wet pipe sprinkler system.

With reference to FIG. 2, the city main 1 provides pressurized water to the underground fire main 3 and to a fire hydrant 5. A key valve 7 is used to control flow of water into the underground fire main 3 and a post indicator valve 9 can measure pressure. The system also includes a main alarm valve drain 53, fire department connection 15, and a water motor alarm 27. A riser 57 connects pressurized water from the underground fire main 3 to a wet pipe alarm valve 59. Past the wet pipe alarm valve 59, the nitrogen generator 25 is connected to the system piping 61. A sparging element 72 is positioned inside the piping to sparge nitrogen from the nitrogen generator 25 into the water within the system piping 61. One or more upright sprinklers 43 or pendent sprinklers 45 are positioned and spaced within the piping network to provide fire protection coverage. These include a pendent sprinkler on drop nipple 63. An inspector's test valve 47 and drain 49 allow testing and/or purging of the system. One or more oxygen sensors 51 are positioned near the inspector's test valve 47 and inspector's test drain 49, adjacent to any system vents 70 and at other terminal portions of the piping network, to measure oxygen and ensure all oxygen or an acceptable level of oxygen is purged from the system.

The embodiments and the examples described herein are exemplary and not intended to be limiting in describing the full scope of apparatus, systems, and methods of the present technology. Equivalent changes, modifications and variations of some embodiments, materials, compositions and methods can be made within the scope of the present technology, with substantially similar results.

What is claimed is:

1. A water-based fire protection system comprising:

a dry pipe sprinkler system comprising at least one fusible sprinkler, a source of pressurized water, a piping network connected to the at least one fusible sprinkler, one or more drains, and a dry pipe valve coupling the source of pressurized water to the piping network, the dry pipe valve having a clapper, the piping network pitched toward the one or more drains, and the one or more drains including a drum drip;

a nitrogen generator coupled to the piping network, the nitrogen generator operable to pressurize the piping network with nitrogen and maintain the clapper of the dry pipe valve in a closed position until the water-based fire protection system is actuated; and at least one vent positioned within the piping network, the at least one vent operable to allow gas including oxygen displaced by the nitrogen to exit the piping network at a preset or adjustable limit while maintaining enough pressure within the system to prevent the clapper of the dry pipe valve from opening until the water-based fire protection system is actuated to thereby increase the concentration of nitrogen and decrease the concentration of oxygen in the piping network to reduce or eliminate the rate of corrosion in the piping network.

2. The water-based fire protection system of claim 1, wherein said at least one fusible sprinkler is operable to depressurize the piping network when fused thereby actuating the water-based fire protection system and allowing the clapper of the dry pipe valve to move to an open position and the pressurized water to fill the piping network and exit the fused sprinkler.

3. The water-based fire protection system of claim 1 further comprising an oxygen sensor coupled to the dry pipe sprinkler system.

4. The water-based fire protection system of claim 3 wherein the nitrogen generator is configured to provide nitrogen to the piping network automatically in response to an oxygen level measured by the oxygen sensor.

5. The water-based fire protection system of claim 1 wherein the nitrogen generator is a nitrogen pressure swing adsorption system.

6. The water-based fire protection system of claim 1 wherein the nitrogen generator is a nitrogen membrane system.

7. The water-based fire protection system of claim 1 wherein the nitrogen generator is capable of generating a continuous supply of at least 90% nitrogen.

8. The water-based fire protection system of claim 7 wherein the nitrogen generator is a nitrogen membrane system.

9. The water-based fire protection system of claim 8, wherein said at least one fusible sprinkler is operable to depressurize the piping network when fused thereby actuating the water-based fire protection system and allowing the clapper of the dry pipe valve to move to an open position and the pressurized water to fill the piping network and exit the fused sprinkler.

* * * * *

UNITED STATES PATENT AND TRADEMARK OFFICE

CERTIFICATE OF CORRECTION

PATENT NO. : 9,144,700 B2
APPLICATION NO. : 12/210555
DATED : September 29, 2015
INVENTOR(S) : Burkhart et al.

It is certified that error appears in the above-identified patent and that said Letters Patent is hereby corrected as shown below:

IN THE SPECIFICATION

At column 7, line 38, please replace

"Electrochemical Reaction: $Fe^0 + ½O_2 + H_2O \rightarrow Fe(OH)_2\downarrow$"

with

"Electrochemical Reaction: $Fe^0 + ½O_2 + H_2O \rightarrow Fe(OH)_2\downarrow$."

Signed and Sealed this
Fifteenth Day of March, 2016

Michelle K. Lee

Michelle K. Lee
*Director of the United States Patent and Trademark Office*